US006543714B1

(12) United States Patent
Ehmann et al.

(10) Patent No.: US 6,543,714 B1
(45) Date of Patent: Apr. 8, 2003

(54) FEEDING DEVICE

(75) Inventors: Wolfgang Ehmann, Linkenheim-Hochstetten (DE); Dietmar Giel, Karlsruhe (DE)

(73) Assignee: Zentes Unitex Textile Machinery GmbH & Co. KG (DE)

( * ) Notice: Subject to any disclaimer, the term of this patent is extended or adjusted under 35 U.S.C. 154(b) by 0 days.

(21) Appl. No.: 09/700,548

(22) PCT Filed: Jun. 8, 1999

(86) PCT No.: PCT/EP99/03927

§ 371 (c)(1),
(2), (4) Date: Nov. 14, 2000

(87) PCT Pub. No.: WO99/67165

PCT Pub. Date: Dec. 29, 1999

(30) Foreign Application Priority Data

Jun. 20, 1998 (DE) ..... 198 27 635

(51) Int. Cl.[7] ..... B65H 67/044

(52) U.S. Cl. ..... 242/474.8; 242/157.1; 242/476.4

(58) Field of Search ..... 242/157.1, 474.8, 242/476.1, 476.4, 920

(56) References Cited

U.S. PATENT DOCUMENTS 4,136,834 A * 1/1979 Tschentscher ..... 242/476.1
4,465,242 A * 8/1984 Ari et al. ..... 242/476.1
4,477,032 A * 10/1984 Pfyffer et al. ..... 242/476.1
4,657,205 A * 4/1987 Sugioka ..... 242/157.1
4,784,342 A * 11/1988 Matthies et al. ..... 242/476.1
5,499,773 A * 3/1996 Raasch et al. ..... 242/157.1 X

FOREIGN PATENT DOCUMENTS

DE 28 53 605 A1 * 6/1979
DE 36 19 286 A1 * 12/1987

* cited by examiner

*Primary Examiner*—Kathy Matecki
*Assistant Examiner*—Minh-Chau Pham
(74) *Attorney, Agent, or Firm*—McGlew and Tuttle, P.C.

(57) ABSTRACT

A feeding device for the simultaneous feeding of several continuously incoming threads on bobbin cases of a winding device located on a bobbin holder for the simultaneous winding with a carrier bracket with thread guides located thereon for each incoming thread provides, for the easy insertion of the threads to be wound into the thread guides and therefore an accurately fitting transfer into the bobbin cases that the thread guides are arranged displaceably along the carrier bracket. The thread guides are displaced parallel to the bobbin holder and consequently also parallel to the bobbin cases located thereon. Thus, with the displacement device it is possible to position the thread guides with clearly defined mutual spacings corresponding to the length of in each case one bobbin case.

17 Claims, 3 Drawing Sheets

FEEDING DEVICE

FIELD OF THE INVENTION

The invention relates to a feeding device for the simultaneous feeding of several continuously incoming threads can bobbin cases located on a bobbin holder for simultaneous; winding, with a carrier bracket and thread guides located thereon for each incoming thread, the thread guides being displaceably arranged by means of at least one displacement device located on the carrier bracket for the displacement of the thread guides parallel to the bobbin holder and for positioning the thread guides with clearly defined mutual spacings along the carrier bracket.

In a feeding device the thread guides serve as initial bearing aids when winding threads onto bobbin cases. With each thread guide is associated a bobbin case, the thread guides being mutually spaced in accordance with the spacings of the bobbin cases.

BACKGROUND OF THE INVENTION

On taking up the thread, the latter must be manually inserted in the thread guide. This was easily possible for a person to carry out, provided that only a limited number of bobbins were located on a bobbin holder, so that the spacing of the bobbins and therefore the thread guides was not excessive. If, for increasing efficiency, several bobbin cases are placed on a bobbin holder, the thread guides associated therewith are distributed over such a length that the threads can no longer be simultaneously gripped by an operator and inserted in the thread guides. Thus, as a result of the spacings of the individual thread guides resulting suiting from the large number of bobbin cases the operator requires increased time and must cover increased distances for inserting the threads.

DESCRIPTION OF THE RELATED PRIOR ART

Feeding devices with a carrier bracket and thread guides for several incoming threads located thereon, in which the thread guides are displaceably arranged by means of a displacement device located on the carrier bracket for the displacement of the thread guides parallel to the bobbin holder and for positioning the thread guides in clearly defined mutual spacings along the carrier bracket are known U.S. Pat. No. (4,465,242, 4,477,032, DE 36 19 286 A1). It is disadvantageous that the feeding devices are only suitable for the simultaneous feeding of a limited number and in particular four threads, because in the case of numerous thread guides distributed over a relatively great length on the carrier bracket they cannot readily be brought sufficiently close together on inserting the threads by the operator for them to be easily accessible to the operator and so as to enable the latter to easily and rapidly insert the threads.

The main object of the invention is to further develop a winding device of the aforementioned type in a simple and cost-effective manner, so that a rapid and easy insertion of in particular a plurality of threads by the operator is ensured and consequently leading to efficiently operating winding devices.

BRIEF DESCRIPTION OF THE INVENTION

Accordingly to the present invention there is provided a feeding device for the simultaneous feeding of several continuously incoming threads on bobbin cases located on a bobbin holder for simultaneous winding, with a carrier bracket and thread guides located thereon for each incoming thread, the thread guides being displaceably arranged by means of at least one displacement device located on the carrier bracket for the displacement of the thread guides parallel to the bobbin holder and for positioning the thread guides with clearly defined mutual spacings along the carrier bracket, wherein furtheron the displacement device is arranged in double homologous manner on the carrier bracket.

The thread guides are displaceable in per se known manner between an insertion position and a transfer position and in the first position the threads are inserted in the thread guides and in the second are transferred from the latter to the bobbin cases. By means of the two double homologously arranged displacement devices a plurality of thread guides can in each case be displaced parallel to the bobbin holders carrying the bobbin cases and a number of thread guides of both displacement devices, which are distributed over a relatively considerable length in the transfer position, can be brought close together for the insertion of the threads in the thread guides by the operation and despite this a complicated and cost-intensive construction of a displacement means for the thread guides, e.g. in the form of an overlong piston-cylinder unit projecting over the carrier bracket is avoided.

On bringing the individual thread guides into their transfer position for winding the threads onto the individual bobbin cases, each displacement device is so designed in per se known manner that the thread guides assume the clearly defined spacings of adjacent bobbin cases with respect to one another. The displacement of the thread guides between the position for inserting the threads and the transfer position for winding the bobbin cases is consequently defined by the displacement device.

In an advantageous embodiment the thread guides are placed by means of plain bearings on a common guide rod of the particular displacement device and are moved by the latter along side guide rod.

In a preferred construction each displacement device has tie rods, which in each case so connect adjacent thread guides that they are displaceable on the tie rod against one another between a minimum and a maximum value, the minimum value applying on insertion of the threads by the operator and the maximum value in the transfer position.

In an appropriate development on the tie rods are provided drivers or positioning means, which cooperate with the individual thread guides and consequently permit a common displacement of the thread guides along the common guide or on pulling apart the thread guides in the transfer position define fixed spacings of adjacent thread guides.

According to a preferred construction, in each case the inner thread guide arranged on the particular guide rod of the two displacement devices is arranged in fixed manner on the guide rod, whereas the outer thread guide placed on the opposite side of the guide rod is displaceable by means of a displacement means cooperating therewith along said guide rod. As a result of the fact that the in each case outer thread guides arranged at opposite ends on the guide rod of the two double homologously arranged displacement devices are displaceable along the guide rod and the in each case inner thread guides of the displacement device are arranged in fixed manner on the guide rod, a plurality of thread guides can be brought in simple manner into a position in which the thread guides are readily accessible for the operator and consequently the threads can be easily and rapidly inserted. Then for the transfer of the threads to the individual bobbins, the thread guides can be pulled apart and in this way associated with the individual bobbins of a bobbin holder, i.e. can be brought to their axial length.

The displacement means is preferably constituted by a double-acting piston-cylinder unit with which it is possible to displace with respect to the fixed thread guide the displaceable thread guides cooperating therewith and, by means of the tie rods, also the other thread guides displaceably positioned on the guide rod.

According to a preferred development the thread guides arranged in fixed manner on the guide rod of the two displacement devices are constructed as a component forming a fixed centre about which can be placed the movable thread guides for the simplified insertion of the threads by the operator.

Advantageously at its free end the thread guides have a receptacle for the threads to be inserted.

The invention is described in greater detail hereinafter relative to an embodiment and the attached drawings, wherein show:

DETAILED DESCRIPTION OF THE PREFERRED EMBODIMENT OF THE INVENTION

Figure 1:
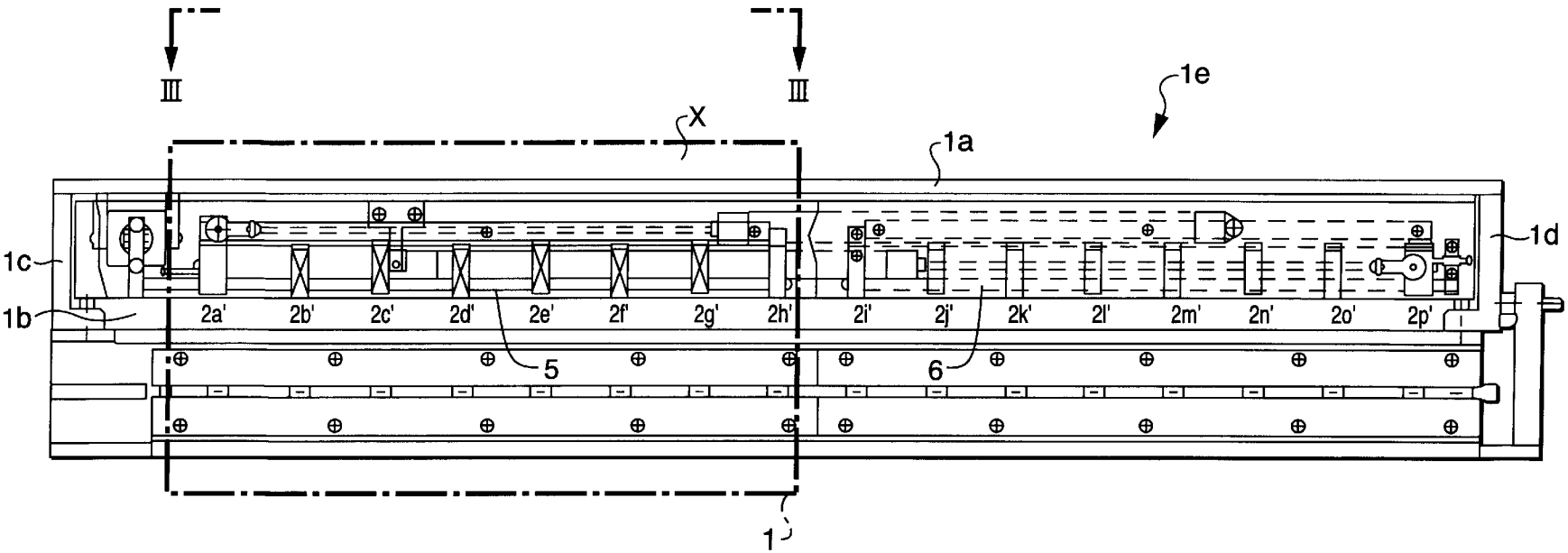
FIG. 1 In a front view a feeding device according to the invention with two homologously arranged displacement devices and thread guides.

The feeding device 1 shown in FIG. 1 is part of a not completely shown winding device for continuously incoming threads. The feeding device 1 has a carrier bracket 1*e* formed from an upper cover plate 1*a*, a lower strut 1*b* and two side parts 1*c*, 1*d* and in which are mounted the further parts of the feeding device. On the carrier bracket 1*e* are located thread guide holders 2*a*'–2*p*' for thread guides not shown in FIG. 1. Below the thread guide holders 2*a*'–2*p*' a not shown bobbin holder with bobbin cases located thereon extends in front of and parallel to the carrier bracket.

Figure 2A:
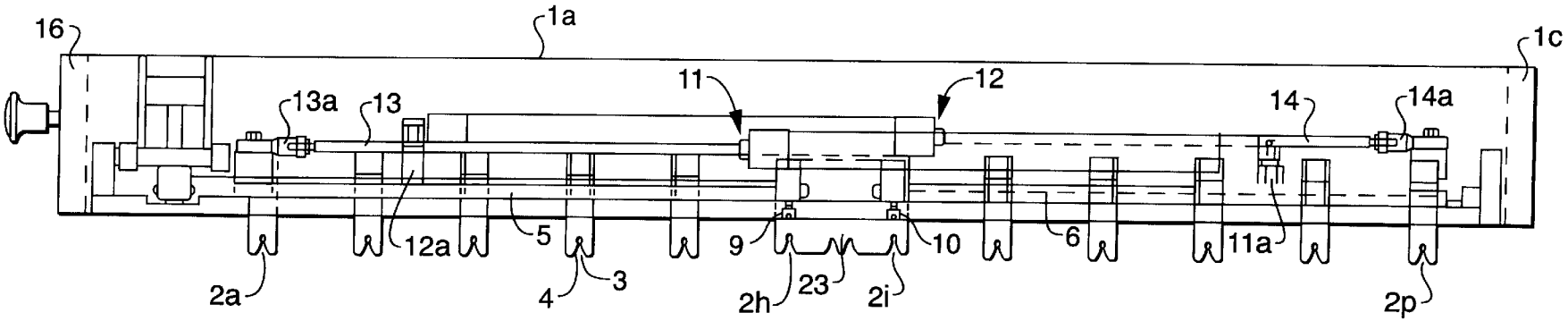
FIGS. 2*a* & 2*b* In plan view, the displacement devices of a feeding device identical to FIG. 1.
Figure 2B:
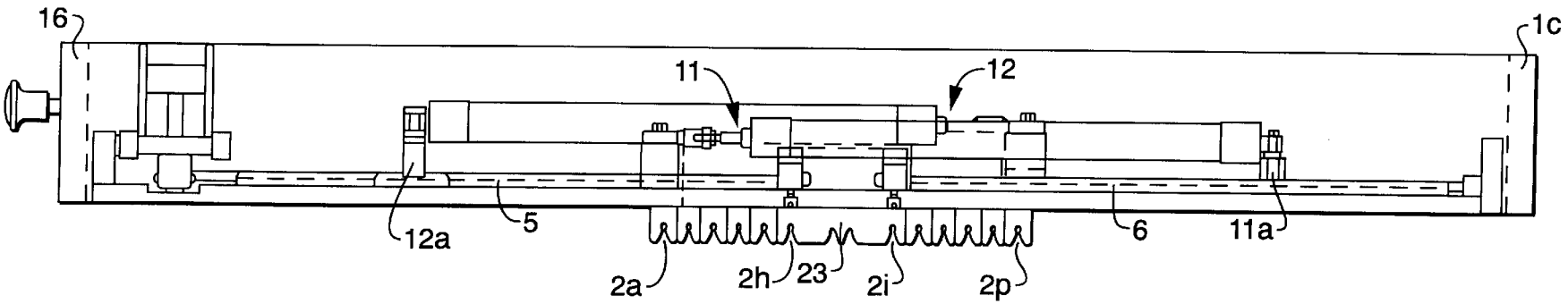

As can be seen from FIGS. 2*a*, 2*b*, the thread guides 2*a*–2*p* are fixed to the thread guide holders 2*a*'–2*p*' (FIG. 1) and extend substantially parallel. Recesses 3 are provided as thread receptacles 4 on the front side of the thread guides 2*a*–2*p*.

By means of the thread guide holders 2*a*'–2*p*' , the thread guides 2*a*–2*p* are displaceable via plain bearings on in each case one of two guide rods 5, 6, the thread guides 2*a*–2*h* being located on the guide rod 5 and the thread guides 2*i*–2*p* on the thread guide 6. Both guide rods 5, 6 are aligned and extend parallel to the cover plate 1*a* and also to the not shown bobbin holder. The central thread guides 2*h* and 2*i* are constructed as a common component 23. The guide rods 5 and 6 are fixed to the thread guide holders 2*h*', 2*i*', which carry said component 23. The arrangement of the thread guides 2*a*–2*h* and 2*i*–2*p* and the guide rods 5 and 6 constructed as slide rails is homologous.

FIGS. 2*a* and 2*b* show a displacement device of the carrier bracket 1*e* of a feeding device in accordance with FIG. 1. In FIGS. 2*a* and 2*b* are shown a reduced number of thread guides 2*a*–2*p* and their thread guide holders 2*a*'–2*p*', the reference numerals of the thread guides relevant for the function of the displacement device being retained from FIG 1.

The thread guide holders 2*h*', 2*i*' of the central thread guides 2*h*, 2*i*, which form the component 23, are fixed by screw connections 9, 10 to the strut 1*b* of the carrier bracket 1*e* and are consequently secured against displacement along the guide rods 5, 6.

The displacement devices have in each case a double-acting piston-cylinder unit 11, 12, which in each case cooperate with one of the two homologous arrangements of thread guides 2*a*–2*h* and 2*i*–2*p* for the displacement thereof on the corresponding guide rod 5, 6 and are fixed to the feeding device 1 by members 11*a* and 12*a*. A piston rod 13 of the double-acting piston-cylinder unit 11 acts by means of a joint head 13*a* on the left-hand, outer thread guide 2*a*, which can consequently be moved by the movement of the piston rod 13 along the guide rod 5. In the same way the homologously arranged, outer, right-hand thread guide 2*p* is moved by means of the piston rod 14 via a joint head 14*a* of the piston-cylinder unit 12 along the guide rod 6. On insertion of the piston rods 13, 14 of the two piston-cylinder units 11, 12 the thread guides 2*b*–2*g* and 2*j*–2*o* are moved inwards by the thread guides 2*a* and 2*p* arranged externally on the guide rods 5, 6 and guided by means of the piston rods 13, 14 in the direction of the fixed, central thread guides 2*h* and 2*i* into an insertion position, shown in FIG. 2*b*, for the threads to be wound on, in that in each case adjacent thread guides engage with one another.

The spacing between the two outer thread guides 2*a*, 2*p* is reduced to a value enabling the operator without having to carry out significant movements to insert the threads in the receptacles 4 of the individual thread guides 2*a*–2*p*.

Figure 3:
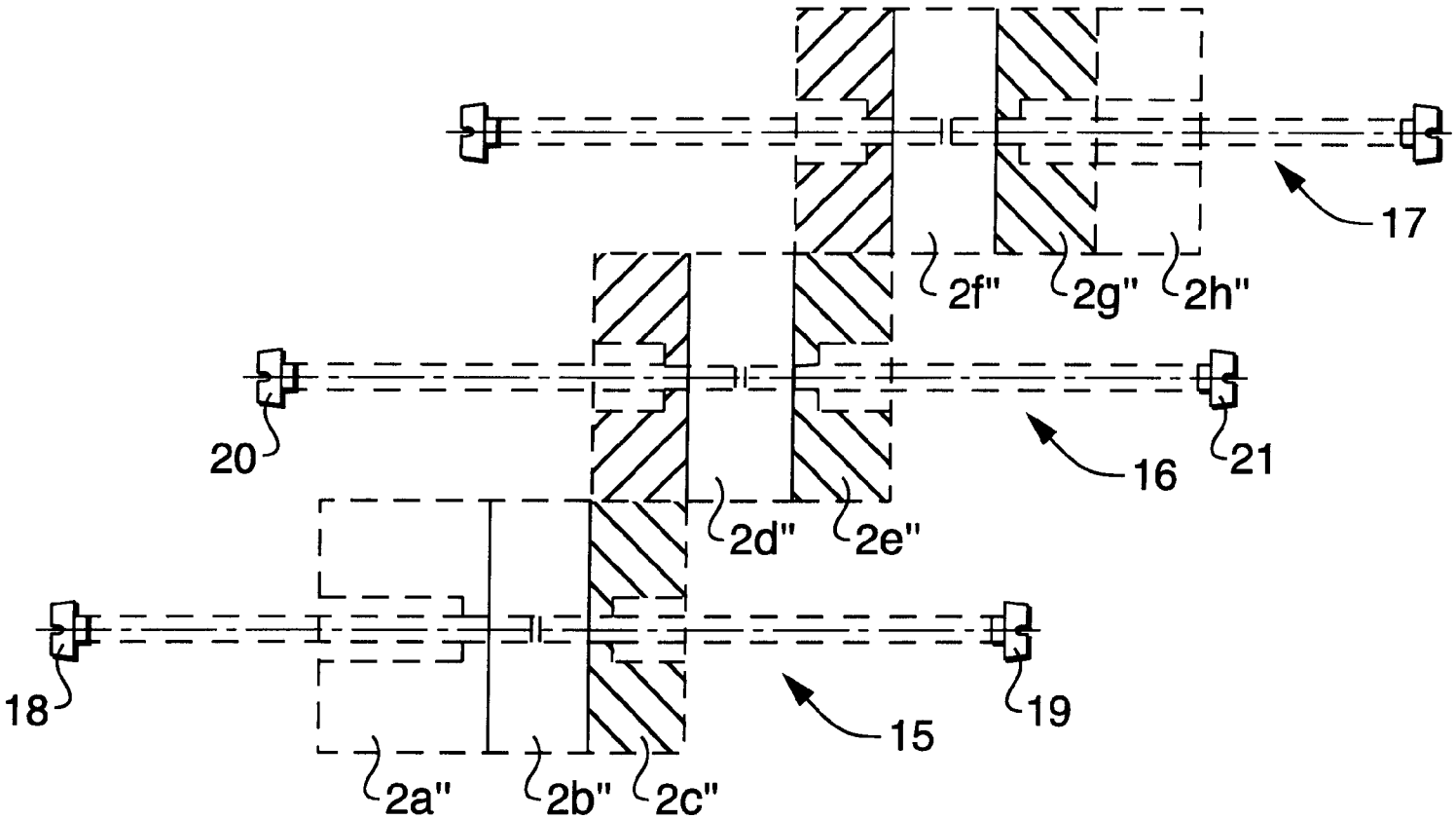
FIG. 3 One side of the device for positioning the thread guides.

Following the insertion of the threads, the outer threads guides 2*a*, 2*p* are moved by means of the piston rods 13, 14 back into their transfer position shown in FIG. 2*a*. On drawing apart the thread guides into their transfer position, the outer thread guides 2*a*, 2*p* carry with them the inner thread guides 2*b*–2*g* and 2*j*–2*o* as a result of the following construction. Their thread guide holders to which they are fixed are connected by means of the tie rods 16, 17, shown in FIG. 3, to the adjacent thread guide holders and therefore their thread guides, the tie rods 15–17 being oriented parallel to one another. FIG. 3 shows the left-hand side of a displacement device according to the fundamental arrangement of FIGS. 2*a*, 2*b*. The thread guide holder 2*a*" is moved outwards (to the left in FIG. 3) by means of the piston rod 13 not shown in FIG. 3 along the guide rod 5 (FIGS. 2*a*, 2*b*) into the transfer position. The tie rod 15 passes through the thread guide holders 2*a*", 2*b*" and 2*c*", the holders 2*a*" and 2*c*" being movable along the tie rod 5 and the holder 2*b*" is fixed thereto. The tie rod 15 is mobile and is driven by the thread guide holder 2*a*", as soon as the latter reaches a head 18 of the tie rod 15 constructed as a driver. Corresponding to the movement of the thread guide holder 2*a*", the tie rod 15 is displaced parallel to the guide rod 5. On displacing the tie rod 15 the thread guide holder 2*b*" fixed thereto is also moved. The thread guide holder 2*c*" is incorporated into the movement of the tie rod 15 as soon as the opposite head of the tie rod 15, also constructed as a driver, engages on the thread guide holder 2*c*". In addition to this tie rod 15, the thread guide holder 2*c*" is traversed by the parallel tie rod 16. When the thread guide holder 2*c*" engages on the head 20 of the tie rod 16, it carries the latter with it and consequently also the thread guide holder 2*d*" and as soon as the head 21 of tie rod 16 engages on the thread guide holder 2*e*" also drives the latter. The connection of the tie rod 17 to the tie rod 16 takes place by means of the thread guide holder 2*e*", which is traversed by the two tie rods 16, 17, like the connection of the tie rods 15, 16 by the thread guide holder 2*c*". The thread guide holders 2*c*", 2*e*" traversed by two adjacent tie rods in the transfer position, i.e. with a maximum spacing of the individual thread guides, are in contact with the heads constructed as drivers located on opposite sides of the tie rods traversing the thread guides, the tie rods having their maximum displacement.

The mutual positioning of the individual thread guides 2*a*–2*h* is fixed by the length of the tie rods 15–17 or the spacing of the two terminations/drivers of each tie rod. The positioning of the homologously positioned thread guides 2*i*–2*p* takes place in the same way.

The feeding device 1 according to the invention is used in the following way. From the transfer position of the thread guides 2*a*–2*p* for the transfer of the threads located therein to the individual, not shown bobbin cases associated with the thread guides 2*a*, 2*p*, shown in FIGS. 1 and 2*a*, following the transfer of the threads the thread guides 2*a*–2*p* are pivoted back from the thread movement path, i.e. perpendicular to the plane of the page of FIG. 1 rearwards and upwards in FIG. 2*a*, so that the threads are released.

Subsequently, by drawing in the piston rods 13, 14 by the piston-cylinder units 11, 12, the thread guides 2*a*–2*p* are brought in the described manner into a position where they are in adjacent contact (FIG. 2*a*). On completely winding the bobbin cases and replacing the same, the thread guides 2*a*–2*p* are again pivoted forwards into the thread movement paths (FIG. 1 with the plane of the page forwards and in FIG. 2*a* downwards). In this closely juxtaposed application position for the threads, an operator can grip a thread bundle with a number of threads corresponding to the number of thread guides 2*a*–2*p* and can insert the threads easily into the individual thread guides 2*a*–2*p* without having to stretch excessively. By the piston-cylinder units 11, 12 by means of the piston rods 13, 14 they are then pulled apart in the transfer position shown in FIGS. 1 and 2*a*, the individual thread guides 2*b*–2*g*, 2*j*–2*o* being driven by the thread guides 2*a*, 2*p* by means of the tie rods 15, 16, 17. The threads are then transferred in per se known manner to the individual bobbin cases. As soon as this has taken place, the thread guides 2*a*–2*p* are pivoted out of the thread guidance path again in the manner described hereinbefore.

What is claimed is:

1. A feeding device for the simultaneous feeding of several continuously incoming threads onto bobbin cases of a winding device arranged on a bobbin holder for simultaneous winding purposes, with a carrier bracket with thread guides, located thereon for each incoming thread, the thread guides being displaceably arranged by means of at least one displacement device located on the carrier bracket for the displacement of the thread guides parallel to the bobbin holder and for positioning the thread guides in predetermined mutual spacings along the carrier, wherein the at least one displacement device displaces the thread guides in a double homologous manner on the carrier bracket.

2. A device according to claim 1, wherein the at least one displacement device has a guide rod, on which the thread guides are displaceably guided.

3. A device according to claim 2 wherein the at least one displacement device has tie rods with which are connected adjacent thread guides in such a way that a spacing of the thread guides is variable between a minimum value and a maximum value.

4. A device according to claim 3, wherein the tie rods have drivers or positioning means in both movement directions of the thread guides along the guide rod.

5. A device according to claim 1 wherein the at least one displacement device has tie rods with which are connected adjacent thread guides in such a way that a spacing of the thread guides is variable between a minimum value and a maximum value.

6. A device according to claim 5, wherein the tie rods have drivers or positioning means in both movement directions of the thread guides along guide rods.

7. A device according to claim 1, wherein an inner thread guide located on a particular guide rod of the at least one displacement device, is fixed to a guide rod, whereas an outer thread guide, located on an opposite side of said guide rod is displaceable along said guide rod by a displacement means cooperating therewith.

8. A device according to claim 7, wherein the displacement means is a double-acting piston cylinder unit.

9. A device according to claim 1, wherein the thread guides of the at least one displacement device arranged in a fixed manner on a guide rod are constructed as a component.

10. A device according to claim 1, wherein the thread guides each have a receptacle for the insertion of a respective said incoming thread.

11. A feeding device according to claim 1, wherein the displaceably arranged thread guides include a first moveable thread guide arrangement disposed relative to a central thread guide in one direction and a second moveable thread guide arrangement disposed in an opposite direction to the central thread guide, the at least one displacement device having a first unit cooperating with the first moveable thread guide arrangement and a second unit cooperating with the second moveable thread guide arrangement, the first unit and the second unit being arranged to be moveable symmetrically in opposite movement directions.

12. A feeding device for the simultaneous feeding of several continuously incoming threads onto bobbin cases of a winding device arranged on a bobbin holder, the feeding device comprising:

a carrier bracket;

thread guides for each incoming thread including a central thread guide, a first moveable thread guide arrangement disposed relative to said central thread guide and a second moveable thread guide arrangement disposed having the same relative position to said central thread guide as said first moveable thread guide arrangement, each of said first moveable thread guide arrangement and said second moveable thread guide arrangement having movable thread guides; and a displacement device located on the carrier bracket for the displacement of said movable thread guides parallel to the bobbin holder and for positioning said moveable thread guides in predetermined mutual spacings along said carrier bracket, said displacement device having a first unit cooperating with said first moveable thread guide arrangement and a second unit cooperating with said second moveable thread guide arrangement, said first unit and said second unit being arranged having a same relative position to a feeding device location, said first unit and said second unit each having a guide rod on which respective said movable thread guides are displaceably guided.

13. A device according to claim 12 wherein the displacement device first unit and second unit each have a tie rod connecting adjacent thread guides such that a spacing of the thread guides is variable between a minimum value and a maximum value.

14. A device according to claim 13, wherein the tie rods are connected to drivers or positioning means in both movement directions of the thread guides along a respective said guide rod.

15. A device according to claim 12, wherein said the thread guides include an inner thread guide located on each said guide rod, each said inner thread guide being fixed to the associated said guide rod.

16. A device according to claim 12, wherein the displacement device includes a double-acting piston cylinder unit.

17. A device according to claim 12, wherein the thread guides have a receptacle for the insertion of one of the incoming threads.

* * * * *